United States Patent [19]

Hurni

[11] 4,342,263

[45] Aug. 3, 1982

[54] RAILWAY WORK-SITE MACHINE EQUIPPED WITH A MECHANICAL UNIT FOR DISPLACEMENT OF THE TRACK

[75] Inventor: Hans Hurni, Ecublens, Switzerland

[73] Assignee: Sig Societe Industrielle Suisse, Chutes du Rhin, Switzerland

[21] Appl. No.: 208,134

[22] Filed: Nov. 19, 1980

[30] Foreign Application Priority Data

Dec. 19, 1979 [CH] Switzerland ..... 11293/79

[51] Int. Cl.[3] ..... E01B 33/06; E01B 33/21

[52] U.S. Cl. ..... 104/7 B

[58] Field of Search ..... 104/7, 7 B, 8, 2, 3, 104/7 R

[56] References Cited

U.S. PATENT DOCUMENTS

| | | | |
|---|---|---|---|
| 3,391,648 | 7/1968 | Stewart | 104/7 B |
| 3,472,174 | 10/1969 | Plasser et al. | 104/7 B |
| 3,602,146 | 8/1971 | Stewart | 104/7 B |

*Primary Examiner*—Richard A. Bertsch

*Attorney, Agent, or Firm*—Hedman, Casella, Gibson & Costigan

[57] ABSTRACT

The rail displacement device, suspended from the chassis of the machine, is composed of a support (8) for lifting hooks (17) for the rails, which support is articulated in an all-azimuth articulation in a joint (11), and of a support (13) with roller wheels (18) for the shifting of the rails, which support is articulated to the hook support.

The two lifting hooks (17) are mounted in transversely adjustable position on a girder (9) of the hook support, which girder is connected to the chassis of the machine by two lifting jacks (20).

The two shifting roller wheels (18) are mounted in fixed positions on a girder (14) of the roller wheel support which girder is connected to the chassis of the machine by two shifting jacks (21).

These two girders are connected by two spacing-adjustment jacks (22).

This device is suitable for tamping-leveling-straightening machines, for the open track and switch gear.

6 Claims, 7 Drawing Figures

RAILWAY WORK-SITE MACHINE EQUIPPED WITH A MECHANICAL UNIT FOR DISPLACEMENT OF THE TRACK

The object of the present invention is a railway work-site machine equipped with a mechanical unit for displacement of the track, articulated in all azimuths and connected to its chassis by lifting shifting and longitudinal-displacement jacks and comprising for its guidance on the track and the grasping of the rails a shifting roller wheel with inner flange and an outer lifting hook which are mounted in opposition on opposite sides of each of the two lines of rails as well as means for adjusting the vertical and transverse position of the path of each hook with respect to the roller wheel which is associated with it.

There are already known tamping-leveling-shifting machines equipped with displacement devices of this type for leveling and straightening the track as they advance, both on the open track and in regions occupied by track gear such as switches and crossings.

In regions occupied by track gear, the three-dimensional mobility of the hooks with respect to the wheels which are associated with them always makes it possible to obtain a hold when the access to the outer contour of one or both lines of rails of the track followed by the two roller wheels is made impossible by the presence of an obstacle such as, for instance, a switch or a frog. It is possible, in fact, upon arriving at the obstacle to clear the hook by raising it above the rail, moving it away sufficiently to move over the obstacle and then lowering it again in order to assume the best grasp for said obstacle at whatever level it may be. It is also possible, within the limits of the transverse stroke of the hook, to go to grasp the outer rail of the converging track on a switch in order to increase the width of the grasp of the track gear in order to facilitate its displacement.

On all these known tamping machines, the two roller wheels and the two hooks of the track displacement device are mounted on a common support to which the lifting jacks and the shifting jacks are connected. On certain of these tamping machines, the mobility of each hook with respect to the roller wheel which is associated with it is obtained by a double translation, on vertical and horizontal slideways, with respect to the common support, in the manner of the tool carriages of machine tools. On another type of such tamping machines, this mobility is obtained by double articulation on two jacks forming a deformable quadrilateral with a common support and the hook. Finally, on these known tamping machines at least one of the two wheels is mounted movable transversely to the track on the common support so as to be able either to modulate the shifting force on the two lines of rails of the track or to adjust the distance between the two roller wheels to the variations in the distance between the two lines of rails of the track followed.

It follows from these various concepts of the shifting device that in all the cases mentioned the track lifting and shifting actions necessarily pass through members for adjusting the relative hook-wheel position acting in the same direction as these actions. Thus the lifting action necessarily passes, between the drive member formed of the lifting jack and the receiving member formed by the hook through the member for adjusting the position in height of the hook with respect to the common support, which is also constituted by a jack. The same phenomenon governs the shifting action. It is therefore necessary to have on these displacement devices a means for locking the position of the receiving members with respect to the common support, once this position has been established, before raising and shifting the track. These means consist of locking means which may be mechanical or hydraulic depending on the member immobilized and the type of tamping machine.

The object of the present invention is to permit the direct transmission of the lifting and shifting actions of the drive members to the members receiving said actions in order to simplify the force transmission structures and increase the reliability.

The solution proposed makes it possible to achieve this purpose by the installation of roller wheels at fixed positions on a roller wheel support which is connected to the shifting jacks, by the installation of the hooks at adjustable transverse positions on a hook support which is connected to the lifting jacks, and by the offcentering between these two supports of at least one jack for adjusting their distance apart in height.

Other advantages inherent in the possibilities afforded by the invention will become evident from the following description.

The accompanying drawings shows by way of example one embodiment of a machine in accordance with the invention as well as three variations of structural details.

Figure 1:
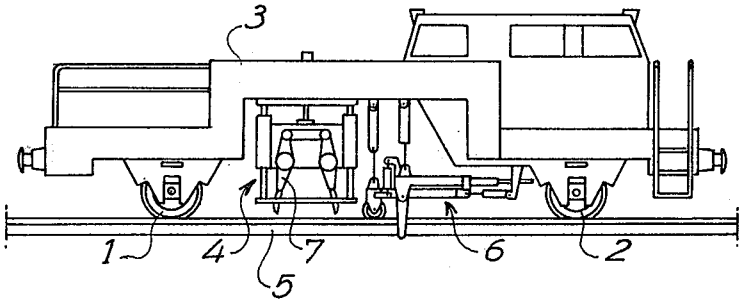
FIG. 1 is a simplified view in elevation of the machine in question.
Figure 2:
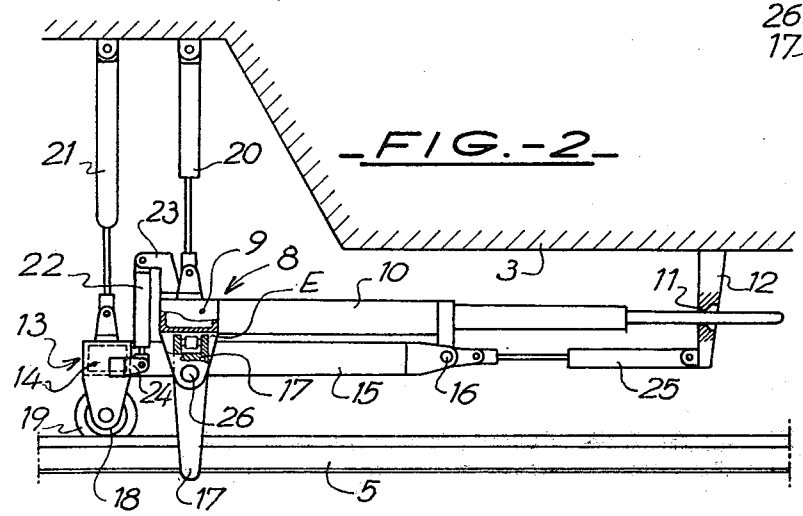
FIG. 2 is a view in elevation of its displacement device.

The machine shown in FIG. 1 is a railway-track tamping, leveling and shifting machine which comprises, between its two axles 1 and 2 and suspended from its chassis 3 a device 4 for tamping ballast below the ties of the track 5 and a unit 6 for the displacement of the track.

It will be recalled here that tamping machines of this type, which have already been described at length, make it possible to lift and shift the track as they advance, so as to bring the track or return it to the required position and consolidate the new position thus obtained by tamping the ballast below the ties. In order to permit work in zones occupied by track gear, the tamping device 4 of these tamping machines, in the same way as the shifting device 6, has tools 7 adapted to be displaced transversely to the track in order to avoid the obstacles represented by said track gear when they are located above them in order to tamp the ties at their level.

The displacement device 6 which characterizes the tamping machine in accordance with the invention and which is shown in detail in FIGS. 2, 3, 4 and 5 is composed of a hook support 8 of tee shape formed of a transverse girder 9 fastened to a longitudinal bar 10 which in its turn is articulated in all azimuths within predetermined limits at its end in a joint 11 borne by a bracket 12 fastened to the chassis 3 of the tamping machine, and of a wheel support 13, also of tee shape, formed of a transverse girder 14 parallel to the girder 9 of the hook support and fastened to a connecting arm 15 pivoted in a plane perpendicular to the said two supports and below the bar 10 of the hook support on a pivot 16 borne by the said bar between its two ends.

Two lifting hooks 17 are mounted movable and adjustable transversely to the track on the two ends of the girder 9 of the hook support 8 while the two roller wheels 18 with inner flange 19 are mounted in fixed position on the girder 14 of the roller wheel support 13, the distance between the bearing faces of the flanges of these two roller wheels being at most equal to the minimum distance between the inner faces of the heads of the two rails 5 of the track. Each of the two lines of rails can be graspered between a hook 17 and a roller wheel 18 which are thus placed in opposition on opposite sides of each of the tracks.

The hook support 8 is displaced in height by two substantially vertical lifting jacks 20 which connect the two ends of the girder 9 of said support to the chassis 3 of the tamping machine while the assembly consisting of the two supports which are thus articulated to each other is displaced laterally by two shifting jacks 21 connecting the girder 14 of the roller wheel support to the chassis 3 of the tamping machine. These two shifting jacks 21 are arranged in known manner with lines of action coming together at a point P which is located substantially at the level of the center of inertia of the track and in a substantially vertical plane.

The two girders 9 and 14 of these two supports 8 and 13 are connected at their ends by two jacks 22 for adjusting their vertical distance apart. These two jacks rest on offset brackets 23 and 24 fastened to these two girders.

The translation of the end of the bar 10 in the joint 11 which translation is intended to permit the avoidance of the ties in order to grasp the bottom of the rails or of the track apparatus by the hooks 17, is controlled by a jack 25 connecting the bracket 12 fastened to the chassis of the tamping machine to the pivot 16 borne by the said bar 10.

Figures 4, 5, 7:
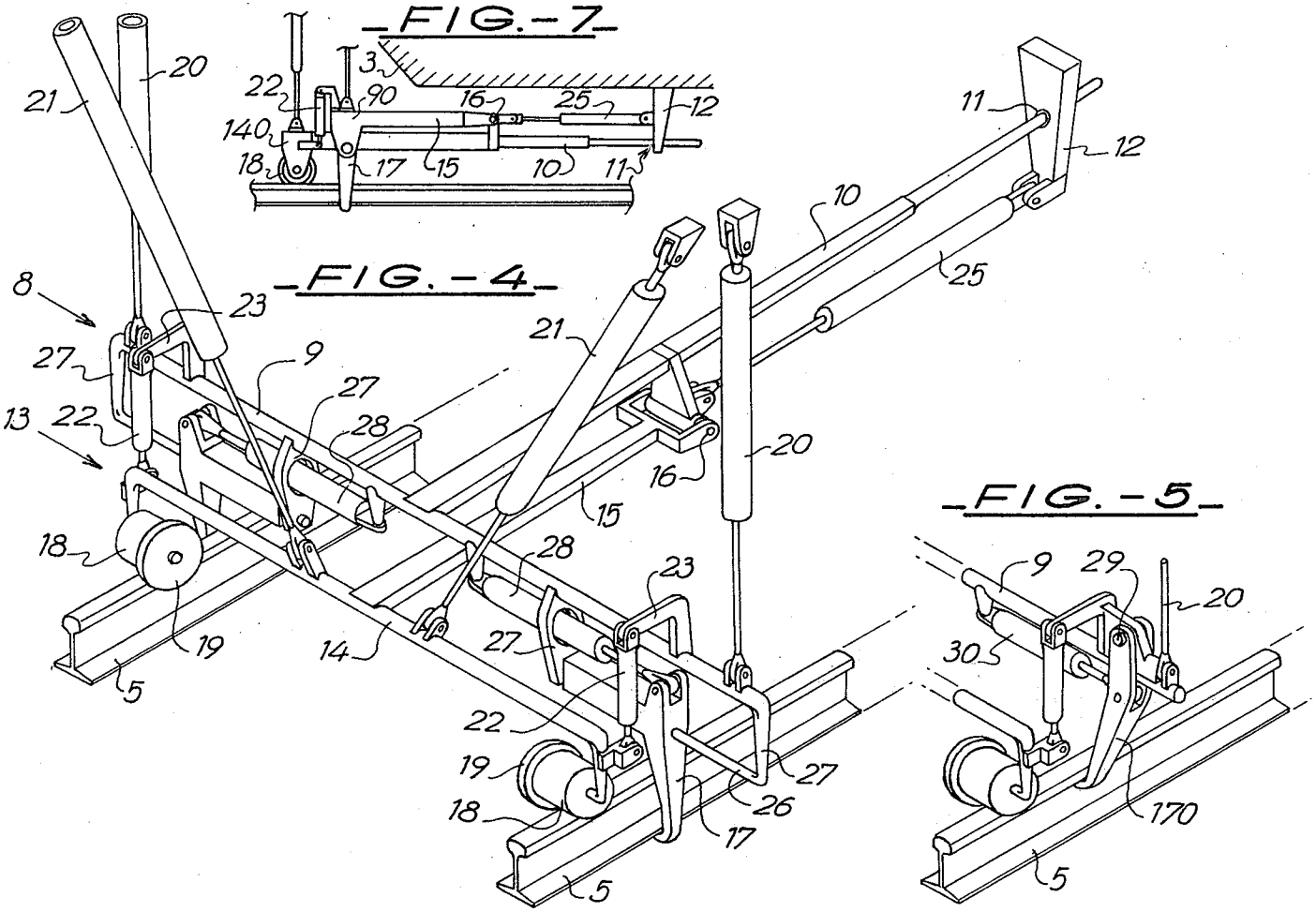
FIG. 4 is a diagrammatic overall view, seen in perspective.
FIG. 5 is a partial view in perspective of a first variant.
FIG. 7 is a diagrammatic partial elevation of the third variant.

Each of the two hooks 17 is mounted for sliding on a round shaft 26 parallel to the girder 9 of the hook support 8, which shaft is supported by two brackets 27; each of them is displaced by a double-acting jack 28 resting against the girder 9 (FIG. 4). The possible rotation of the hook 17 around the shaft 26 is limited to a predetermined value by the amount of the play E (FIG. 2) left between the upper face of the hook 17 and the lower face of the girder 9. This limited possibility of rotation is intended to compensate for the slight variations in position of the active lower end of the hook with respect to the roller wheel which is associated with it which occur between the grasping of the rail before the displacement of the track and the combined lifting and shifting action when the longitudinal displacement jack 25 of the displacement unit is blocked during these last operations. However, this feature is not indispensable when the elasticity of the mechanical assembly is capable of absorbing these variations without damage.

It will be noted here, in view of the geometry of the articulation system of the displacement unit, that the amount of these variations in position is inversely proportional to the distance present between the hook 17 and the articulation of the jack 25 on the bracket 12 and is little affected by the vertical position of the pivot 11 in which the end of the bar 10 translates and pivots. It is therefore important to arrange this articulation of the jack 25 as far as possible from the girder 9 of the hook support and as low as possible on the bracket 12.

Developed in this manner, the track displacement device of the tamping machine in accordance with the invention imparts to the lifting hook 17 a three-dimensional mobility which is comparable to that of the known devices indicated in the preamble while making it possible to achieve the purpose sought in accordance with the teaching of the invention. As a matter of fact, the lifting forces supplied by the lifting jacks 20 are transmitted directly by the hook support 8 to the lifting hooks 17 without passing through the jacks 22 for the adjustment of the vertical position of these hooks which act in the same direction. Likewise, the shifting forces supplied by the jacks 21 are transmitted directly by the wheel support 13 to that one of the two wheels 18 whose flange 19 is placed by these forces against one of the two rails 5 of the track, without passing through the means for adjustment of the transverse position of these roller wheels with respect to their support, these means being eliminated in this construction, which permits a natural distribution of the said shifting forces on the two lines of rails via the hook support. This latter effect is obtained in the following manner: After the placing of the two hooks 17 on the two lines of rails 5 by means of the two jacks 28, while the track is shifted by the action of the shifting jacks 21, the hook 17 associated with the roller wheel 18 which receives the shifting forces is driven in the same direction by the rail 5 which receives the push of this roller wheel; as this hook which is entrained by the rail is connected by its support 8 to the other hook resting on the other line of rails, the latter is also driven in its turn in the same direction by this other hook. The distribution of the shifting forces between the two lines of rails is thus obtained as a function of the lateral load capacity of each of the two lines of rails at the place of action.

This natural distribution can also be obtained in a first variant, shown in FIG. 5, in which hooks 170 pivoting in a vertical plane transverse to the track are mounted on the girder 9 of the hook support 8. In this variant, each hook 170 is articulated on a pivot 29 which is fastened as high as possible on the girder 9 so as to obtain a trajectory of circular arc with reduced sag at the level of the active base of the hook. This hook 170 is actuated transversely by a jack 30 resting against the girder 9. This simplified variant is applicable when large lateral differences in position between the active portions of the hooks and the roller wheels which are associated with them are not required.

For high-output use on the open track the active ends of the hook 17 of the device described and of the hooks 170 of the first variant will advantageously be replaced by roller wheels having substantially vertical axes of rotation and having a lifting flange which can be applied below the head of the rails, this adaptation not resulting in any change in the other elements of the basic structure, such flanged roller wheels obviously serving as hooks within the meaning of the invention.

Due to the stagger between roller wheels and hooks along the rails and the initial play between roller wheels and rails, when the track is displaced, this play, the lateral bending of the rails due to the shifting wave and the rotation of the displacement device around the joint 11 in the plane of the track cause transverse relative movements between the hook 17 and the roller wheels 18 which can be absorbed by the flexibility of the connection of the two supports 8 and 13 and the inherent flexibility of the two hooks. However, it is possible to relieve this connection as well as the hooks from these elastic deformations. This relief is obtained by means of a connecting circuit established between two homologous chambers of the two jacks 28 for the control of the transverse displacement of the two hooks 17.

Figure 3:
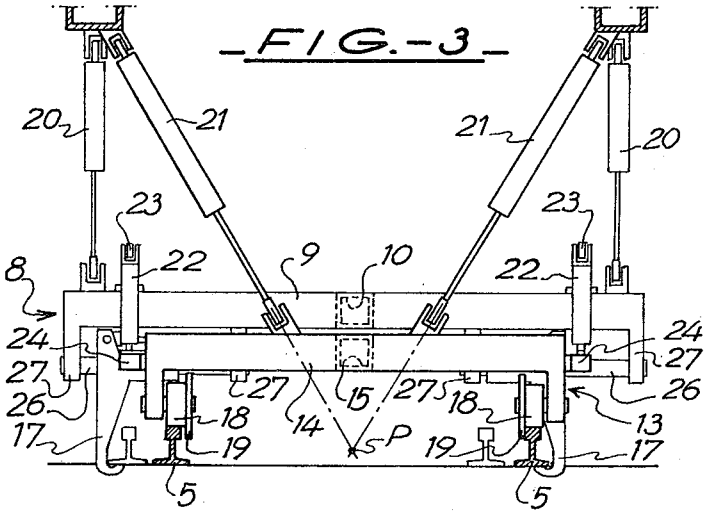
FIG. 3 is a left-hand view of said device.
Figure 6:
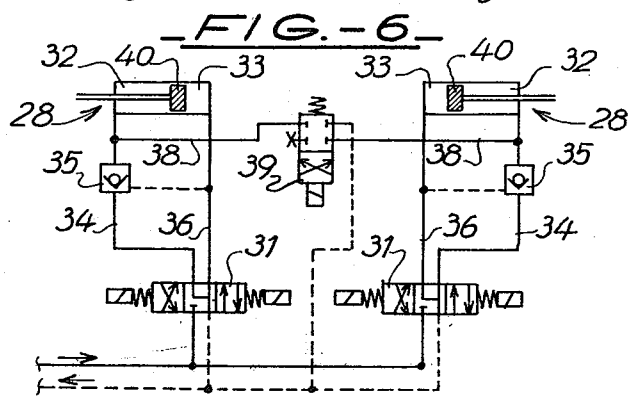
FIG. 6 is a partial hydraulic diagram referring to a second variant.

This second variant is illustrated by the diagram of FIG. 6 which shows the portion of the feed circuit of the two double-acting jacks 28 which connects them to their respective control distributors 31, which are three-position distributors with double electromagnetic control and spring return.

The outer chamber 32 of each of these two jacks is connected to the distributor 31 by a conduit 34 containing a controlled non-return valve 35, while the inner chamber 33 of each of these same jacks is connected to the distributor 31 by a conduit 36. The two outer chambers 32 of the two jacks 28 are connected by a conduit 38 which is connected to the two conduits 34 extending into these chambers between the latter and the non-return valves 35. A two position distributor 39 with electromagnetic control and spring return is interposed between the two points of connection of this conduit 38 to the conduits 34.

In the position of the distributor 39 shown in the figure, the conduit 38 is out of the circuit and the displacements of the piston 40 of the two jacks 28 can be controlled in both directions by the distributor 31 so as to place the two hooks 17 on the selected place of the two lines of rails of the track to be displaced. Once this positioning has been effected and before the track displacement operation, the conduit 38 is placed in the circuit by the distributor 39, while the two distributors 31 are placed in the shown position of return of the two conduits 36 to the tank. At this time the volume of the fluid contained in the two outer chambers 32 of the two jacks 28 is blocked and can circulate freely from one of these two chambers to the other this having the effect of maintaining the spacing between hooks 17 which was established when they were placed against the rails while returning to these hooks their transverse mobility with respect to the hook support 8.

In this way, the hooks 17 can freely follow the rails in their movements relative to the shifting roller wheels 18 while holding them firmly at the established distance apart. This effect further increases the distribution of the shifting forces on the two lines of rails of the track which was previously mentioned.

Other variants, not shown, can be provided in the development of the track displacement device of the machine in accordance with the invention.

Thus the articulation of the roller wheel support 13 on the hook support 8, which is effected by offset of the pivot 16 of this articulation on the bar 10, which has the advantage, by its distance away, of limiting the relative movements between hooks 17 and roller wheels 18 during the combined lifting and shifting operation, can be realized differently. For example, two connecting arms rigidly fastened to the two ends of the girder 14 can be articulated directly to two pivots fixed to the ends of the girder 9 of the hook support 8 and in this case a single jack for adjusting the distance between these two girders can be installed between these two arms.

Likewise the all-azimuth articulation of the hook support, which has the advantage of simplicity, can be replaced by two jacks parallel to the longitudinal axis of the track and connecting the two ends of the girder 9 to the chassis of the machine. In this case, the bar 10 is no longer fixed rigidly to the girder 9 but articulated to it on a vertical pivot so as only to avoid the tilting of the assembly of the two supports.

The limited rotation of each hook 17 around its translation-guidance round shaft 26 can be supplemented by an elastic means for return to the neutral position in order to avoid pendulum movements of the hook in periods when not in use. This elastic means can consist, for instance, of two lateral rocking bars articulated on the upper part of the hook 17 and held pressed against the lower wall of the girder 9 by two springs of the same power.

In the case of very high shifting forces to be transmitted from one line of rails to the other, two jacks can advantageously be interposed between the arm 15 of the roller wheel support 13 and the hooks 17 so as to transmit a given portion of said force directly to the hook 17 acting on the line of rails opposite the one shifted by a roller wheel 18 so as to proportionally alleviate the hydraulic connection of the two jacks 28 for adjustment of the distance between the two hooks 17 as well as the roller wheel 18 which receives the shifting force.

Finally, in a third variant shown in FIG. 7, which also makes it possible to achieve the desired purpose, it is the transverse girder 140 of the roller wheel support which has a bar 10 with all-azimuth articulation in a joint 11 supported by a bracket 12 fastened to the chassis 3 of the machine and it is the girder 90 of the hook support which has an arm 15 articulated on a pivot 16 borne by the said bar.

This last variant, in which the articulation of the jack 25 is raised as compared with the embodiment described, is applicable when the space available below the chassis of the machine makes it possible to move the bracket 12 further away.

I claim:

1. In a railway work-site machine having a chassis and a track displacing mechanical unit articulated in all azimuths and connected to said chassis by lifting, shifting and longitudinal displacement jacks, which unit comprises a shifting roller wheel with inner flange and an outer lifting hook mounted in opposition to each other on opposite sides of each line of rails for the guiding thereof on the track and for the grasping of the rails and means for adjusting the height and track respective transverse position of each lifting hook with respect to the roller wheel associated therewith, the improvement of the track displacing mechanical unit being composed of a hook support comprising a transverse girder on the two ends of which the two lifting hooks are mounted movable and adjustable transversely to the track and of a roller wheel support comprising a transverse girder parallel to the hook support girder and on the two ends of which the two shifting flanged roller wheels are mounted in fixed position, wherein one of said two transverse girders is connected to the chassis of the machine by a full-azimuth articulation device comprising at least one longitudinal displacement jack, said girder having a pivot on which is articulated and pivotally mounted in a plane perpendicular to said two girders at least one connecting arm to which is fastened the other girder, wherein the lifting jacks are connected to the lifting hook support and the shifting jacks are connected to the shifting roller wheel support, and wherein the two transverse girders of said two supports are connected by at least one jack for the adjustment of their height difference, whereby each lifting and shifting action passes directly from the lifting and shifting jacks to the hooks and flanged roller wheels.

2. In a machine according to claim 1, the further improvement of the transverse girder connected to the machine chassis being fastened to a longitudinal bar articulated in all azimuths by its end in a joint borne by a bracket fastened to said chassis, said bar being connected to said bracket by a jack controlling the translation of the end of said bar in said joint.

3. In a machine according to claim 2, the further improvement of the pivot to which is articulated the connecting arm being fastened between the two ends of the longitudinal bar of the girder connected to the chassis.

4. In a machine according to claim 3, the further improvement of the transverse girders of the two supports being connected at their two ends by two jacks for regulating their height distance apart.

5. In a machine according to claim 1, the further improvement of each of said two lifting hooks being mounted movable and transversely adjustable on the girder of the hook support by translation on a round shaft parallel to said girder, wherein said translation is controlled by a double acting jack resting on said girder, and wherein the possible rotation of said hook around said shaft is limited to a predetermined value.

6. In a machine according to claim 5, the further improvement of the two jacks controlling the translation of the two hooks being fed by a hydraulic circuit comprising a connecting conduit joining the two homologous chambers of said two jacks, wherein said connecting conduit is placed in and out of circuit by a distributor connected in said conduit between said two chambers.

* * * * *